US005579642A

United States Patent [19]

Wilke et al.

[11] Patent Number: 5,579,642

[45] Date of Patent: Dec. 3, 1996

[54] PRESSURE COMPENSATING HYDRAULIC CONTROL SYSTEM

[75] Inventors: Raud A. Wilke, Dousman; Eric P. Hamkins, Waukesha; Michael C. Layne, Waterford; Leif Pedersen, Waukesha; Lynn A. Russell, Eagle, all of Wis.

[73] Assignee: Husco International, Inc., Waukesha, Wis.

[21] Appl. No.: 451,636

[22] Filed: May 26, 1995

[51] Int. Cl.[6] ..... F15B 13/02

[52] U.S. Cl. ..... 60/426; 60/452; 91/446; 91/518

[58] Field of Search ..... 60/426, 427, 452; 91/446, 512, 518, 531

[56] References Cited

U.S. PATENT DOCUMENTS

| | | | |
|---|---|---|---|
| 4,693,272 | 9/1987 | Wilke | 137/596 |
| 5,000,001 | 3/1991 | Christensen et al. | 91/446 X |
| 5,067,389 | 11/1991 | Germain | 91/446 |
| 5,146,747 | 9/1992 | Sugiyama et al. | 91/446 X |
| 5,161,373 | 11/1992 | Morikawa et al. | 91/446 X |
| 5,211,196 | 5/1993 | Schwelm | 91/446 X |
| 5,347,811 | 9/1994 | Hasegawa et al. | 91/446 X |
| 5,415,199 | 5/1995 | Claudinon et al. | 91/446 X |

*Primary Examiner*—Hoang Nguyen
*Attorney, Agent, or Firm*—Quarles & Brady

[57] ABSTRACT

An improved pressure-compensated hydraulic system for feeding hydraulic fluid to one or more hydraulic actuators. A remotely located, variable displacement pump provides an output pressure equal to input pressure plus a constant margin. A pressure compensation systems requires that a load-dependent pressure be provided to the pump input through a load sense circuit. A reciprocally spooled, multi-ported isolator transmits the load-dependent pressure to the pump input but prevents fluid in the load sense circuit from leaving the load sense circuit and flowing through a relatively long conduit leading to the remotely located pump. In a multi-valve array, at least one valve section has a back-flow-preventing shuttle valve which prevents backflow through the pressure compensation system if a main relief valve is operative.

5 Claims, 4 Drawing Sheets

PRESSURE COMPENSATING HYDRAULIC CONTROL SYSTEM

FIELD OF THE INVENTION

The invention relates to valve apparatuses which control hydraulically powered machinery.

BACKGROUND

The speed of movement of a hydraulically driven working member of a machine depends on the cross-sectional area of the principal narrowed orifices of the system and on the pressure drop across those orifices. To facilitate control, pressure compensating hydraulic control systems have been designed to eliminate one of those variables, pressure drop. These systems include sense lines which transmit the pressure at one or more workports to the input of a variable displacement hydraulic pump which provides pressurized hydraulic fluid to actuators which drive working members of the machine. The resulting self adjustment of the pump output provides an approximately constant pressure drop across a control orifice whose cross-sectional area can be controlled by the machine operator. This facilitates control because, with the pressure drop held constant, the speed of movement of the working member is determined only by the cross-sectional area of the orifice. One such system is disclosed in U.S. Pat. No. 4,693,272 issued to Wilke on Sep. 15, 1987, the disclosure of which is incorporated by reference.

Because in such a system the control valves and the hydraulic pump are normally not immediately adjacent to each other, the changing load pressure information must be transmitted to the remote pump input through hoses or other conduits which can be relatively long. Some oil tends to drain out of these conduits while the machine is in a stopped, neutral state. When the operator again calls for motion, these conduits must refill before the pressure compensation system can be fully effective. Because of the length of these conduits, the response of the pump may lag, and a slight dipping of the loads can occur. These may be referred to as the "lag time" and "start-up dipping" problems.

In some types of such systems, the "bottoming out" of a piston driving a load could cause the entire system to "hang up". This could occur in such systems which used the highest of the workport pressures to motivate the pressure compensation system. The bottomed out load would be the highest workport pressure; the pump could not provide a higher pressure; and thus there would no longer be a pressure drop across the control orifice. As a remedy, such systems may include a pressure relief valve in a load sensing circuit of the hydraulic control system. In the bottomed out situation, it would open to drop the sensed pressure to the load sense relief pressure, and this would allow the pump to provide a pressure drop across the control orifice.

While this solution is effective, it could have an undesirable side effect in systems which use a pressure compensating check valve as part of the means of holding substantially constant the pressure drop across the control orifice. The pressure relief valve could open even when no piston was bottomed out if a workport pressure exceeded the set point of the load sense relief valve. In that case, some fluid could flow back from the workport, backwards through the pressure compensating check valve, and into the pump chamber. As a result, the load could dip. This may be referred to as the "backflow" problem.

For the foregoing reasons, there is need for means to reduce or eliminate the problems of lag time, start-up dipping and backflow in some applications.

SUMMARY

The present invention is directed toward satisfying those needs.

A hydraulic valve assembly for feeding hydraulic fluid to a load includes a pump of the type which produces a variable output pressure which at any time is the sum of input pressure at a pump input port and a constant margin pressure. Included in the hydraulic valve assembly is a pressure compensating valve apparatus adapted to feed fluid from the pump to the load through a metering orifice and to provide a constant pressure drop across the metering orifice. The valve apparatus includes a load sense circuit which communicates a first load-dependent pressure to an isolator and a second load-dependent pressure from the isolator to the metering orifice. The pressure drop across the metering orifice is the difference between the pump output pressure and the second load-dependent pressure.

The isolator includes a reciprocally sliding spool in a bore which is defined by one or more bore surfaces. The spool has a plurality of lands and narrow portions which, with the one or more bore surfaces, define the following chambers. An input chamber is in communication with the load sense circuit so that the first load-dependent pressure produces an input force urging the spool in a first direction. A connecting chamber is in communication with the pump output pressure and connects the pump output pressure to an isolator output port in a bore inner surface as the spool moves in the first direction and disestablishes that connection as the spool moves in a second direction opposite the first. A reservoir chamber is in communication with the reservoir and establishes communication between the isolator output port and the reservoir as the spool moves in the second direction and disestablishes that connection as the spool moves in the first direction. A feedback chamber is in communication with the isolator output port through a feedback bore in the spool. The pressure in the feedback chamber produces a feedback force urging the spool in the second direction.

Pump output pressure is thereby communicated to the feedback chamber and urges the spool in the second direction. Continued movement in the second direction disestablishes the connection between the pump output pressure and the isolator output port and establishes a connection between the reservoir and the isolator output port and therefore the feedback chamber. As a result, the spool tends at any time to an equilibrium position at which the second load-dependent pressure at the isolator output port is a function of the first load-dependent pressure. The first and the second load-dependent pressures may or may not be equal to each other.

The isolator output port is in communication with the pump input port and with the load sense circuit which communicates the second load-dependent pressure to the metering orifice of the pressure compensating valve apparatus. Accordingly, the pump input port sees the second load-dependent pressure but does not receive fluid flow from the load sense circuit, and the constant pressure drop across the metering orifice of the pressure compensating valve assembly is the margin pressure.

The hydraulic valve system may comprise an array of pressure compensating valve sections for feeding hydraulic fluid from a pump to a plurality of hydraulic actuators in communication with pressure in the workports of the valve sections. The pump is of the type which produces an output pressure which is a constant amount greater than the pump input pressure. The array is of the type in which the highest pressure of all the workports is sensed and transmitted to a pressure relief valve and in which the pressure relief valve transmits to the pump input and to a pressure compensating valve in each valve section a load sense pressure equal to the lower of (a) the set point pressure of the pressure relief valve and (b) the highest workport pressure. Each pressure compensating valve provides the load sense pressure at one side of a metering orifice which sees on the other side the pump output pressure so that the pressure drop across the metering orifice is equal to the constant amount. In at least one valve section, there is a switching valve between the relief valve and the pressure compensating valve. The switching valve may be a shuttle valve. The switching valve transmits to the pressure compensating valve of the valve section the higher of (a) the load sense pressure or (b) the highest workport pressure of said at least one valve section. As a result, the pressure compensating valve will be held closed to prevent backflow whenever the pressure relief valve is open.

It will be recognized that the inventions claimed herein offer several advantages. The lag time and start-up dipping problems are substantially eased by a circuit and structure which isolate the fluid in the load-sensing, pressure-compensating valve from the remote pump input and yet transmit the load-pressure information to the pump input. Backflow is substantially reduced by a circuit and structure which prevents back flow through a pressure compensating check valve.

These and other features, aspects and advantages of the present invention will become better understood with reference to the following description and drawings of a preferred embodiment of the invention. The invention is, however, not limited to that embodiment.

DETAILED DESCRIPTION OF A PREFERRED EMBODIMENT

The Pressure Compensating Hydraulic Control System

Figure 1:
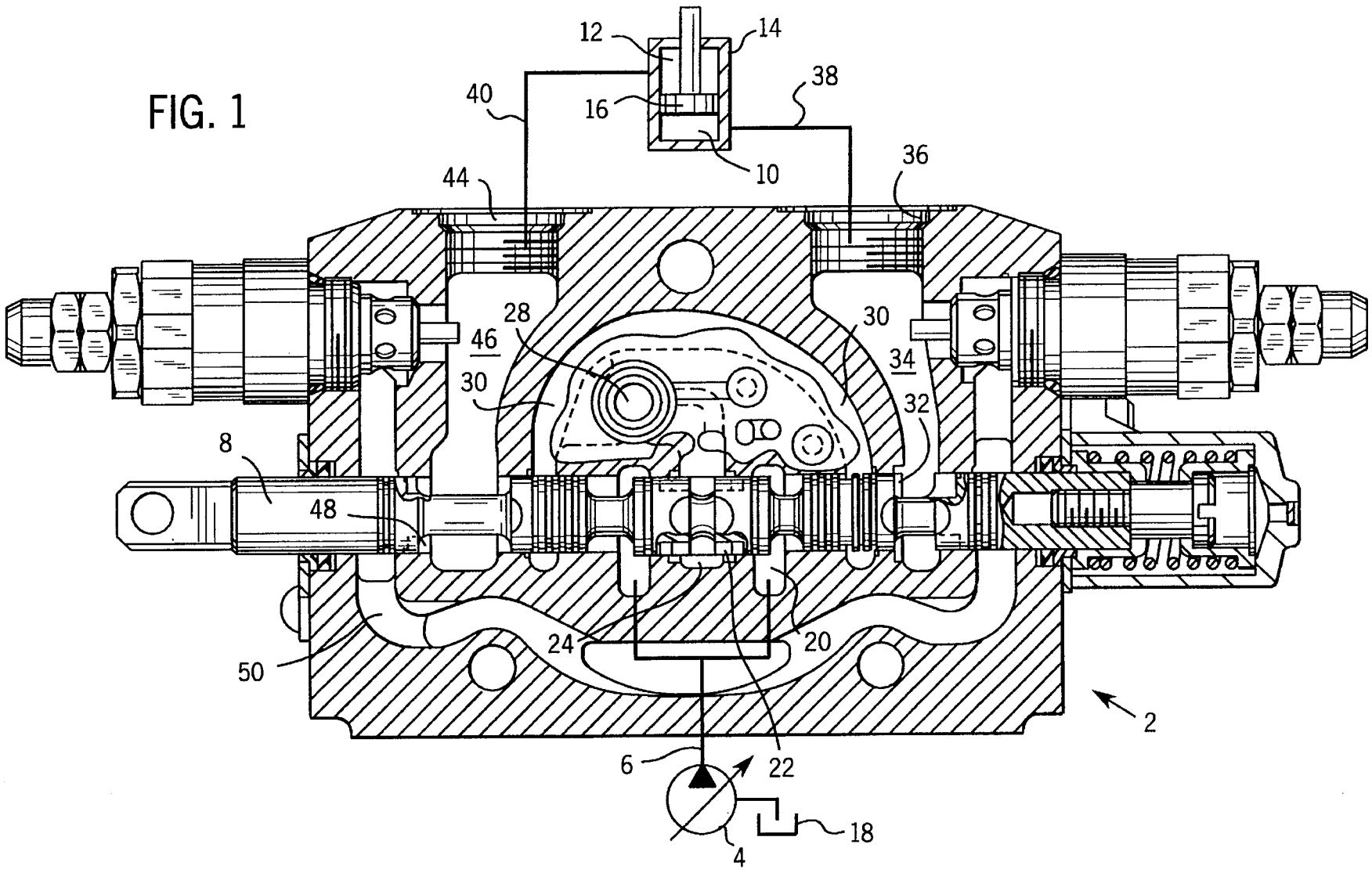
FIG. 1 is a partially schematic, partially sectional side-view of a valve which embodies the invention.
Figure 2:
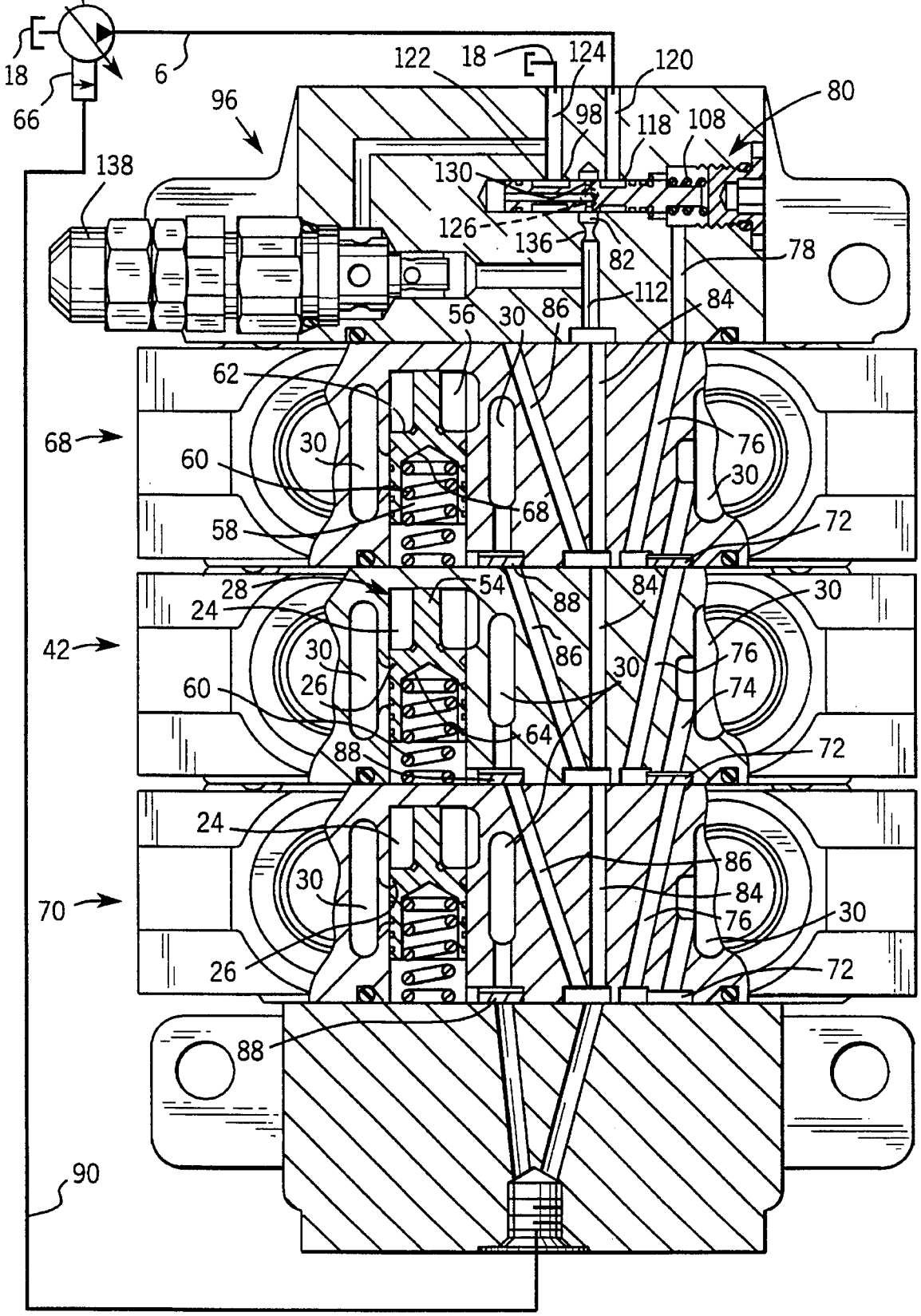
FIG. 2 is a partially sectional top view of an assembly of valves embodying the invention.
Figure 3:
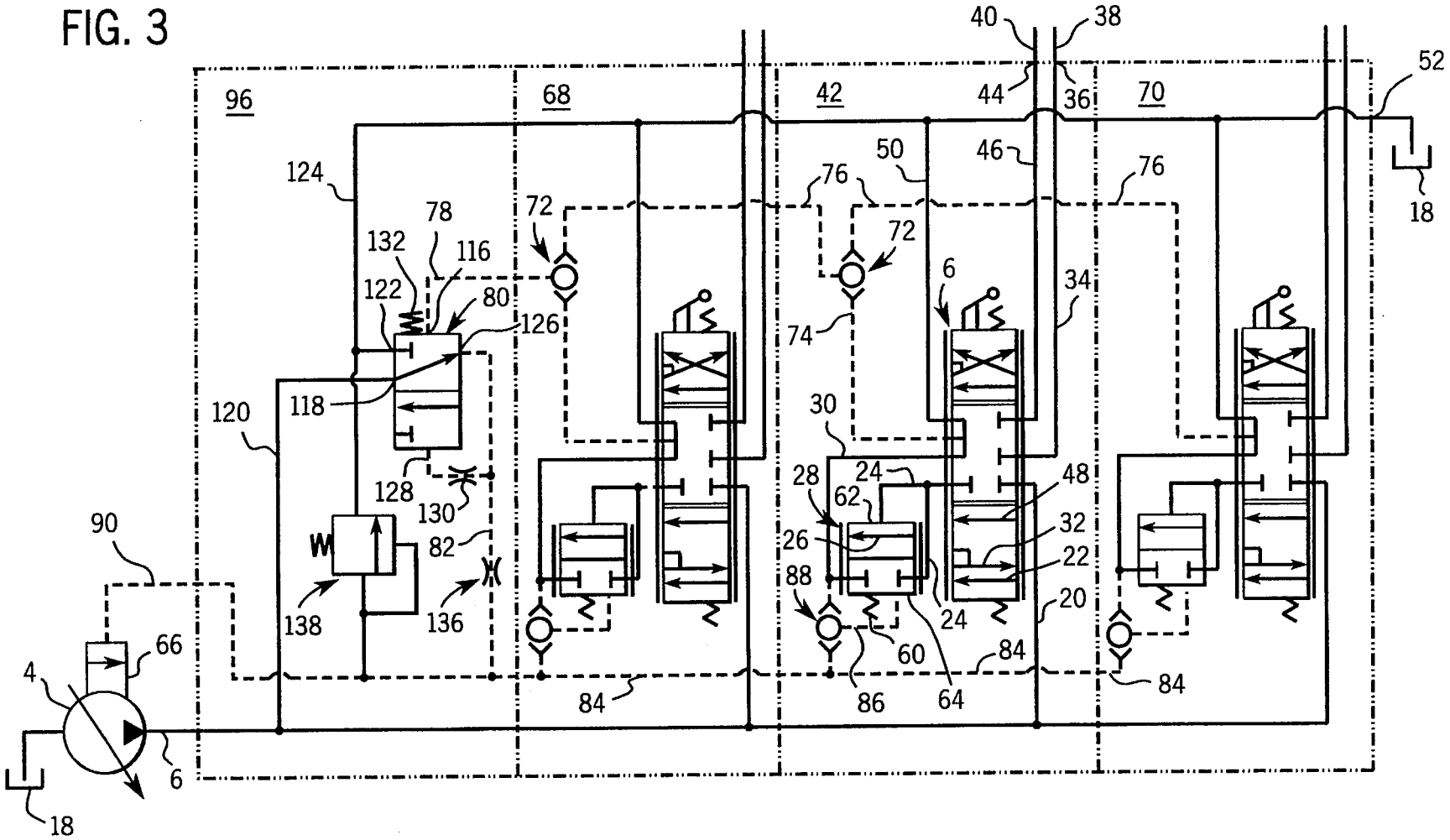
FIG. 3 is a diagram of one version of a hydraulic circuit in which the claimed invention may be employed.

In FIG. 1, valve 2 is of a type used to control one degree of movement of a hydraulically-powered working member of a machine. FIGS. 2 and 3 show three of such valves interconnected to form a multiple valve assembly which together could control all of motions of one or more of the working members of a machine. A pump 4 is typically located remotely from the valve assembly, being connected by a supply conduit or hose 6.

To facilitate understanding of the inventions claimed herein, it is useful to describe basic fluid flow paths in the embodiment shown in the Figures.

As shown in FIG. 1, the valve 2 has a control spool 8 which the operator can move in either direction by remote means not shown. Depending on which way the spool is moved, hydraulic fluid (hereinafter "oil") is directed to the lower 10 or upper 12 chamber of a cylinder housing 14 and thereby drives up or down a piston 16 which is connected to a working member (not shown). The extent to which the operator moves the control spool determines the speed of movement of the working member. Each of the valves in the assembly shown operates similarly, and the following description can be applied to each of the valves.

To move the piston 16 upward (in the orientation of FIG. 1), the operator moves a controller (not shown) which moves the control spool 8 leftward (in the orientation of FIG. 1). This opens passages which allows the pump 4 (under the control of the load sensing network to be described later) to draw oil from the reservoir 18 and force it to flow through pump output conduit 6, into a supply passage 20 in the valve, through a control orifice (the metering notch 22 (FIG. 1) of the control spool 8), through feeder passage 24 (FIGS. 1 and 2), through the variable orifice 26 (FIG. 2) of the pressure compensating check valve 28 (to be discussed below), through bridge passage 30, through passage 32 of the control spool 8, through workport passage 34, out of work port 36, through an external workport conduit 38 and into the lower chamber 10 of the cylinder housing 14. The pressure thus transmitted to the bottom of the piston 16 causes it to move upward, which forces oil out of the top chamber 12 of the cylinder housing 14.

This forced-out oil flows through the conduit 40, into middle valve 42 via workport 44, through the workport passage 46, through the reciprocal control spool 8 via passage 48, through reservoir core 50 to the reservoir port 52 (FIG. 3) which is connected to the reservoir 18.

To move the piston 16 downward (in the orientation of FIG. 1), the operator moves the controller oppositely, which causes the reciprocal control spool 8 to move rightward (in the orientation of FIG. 1), which opens a corresponding set of passages so that the pump 4 forces oil into the top chamber 12, and out of the bottom chamber 10 of the cylinder housing 14, causing the piston 16 to move downward.

In the absence of a pressure compensation apparatus, the operator would have difficulty controlling the speed of movement of the piston 16. A reason for that difficulty is that the speed of piston movement is directly related to the rate of flow of the oil, which is determined primarily by two variables—the cross sectional areas of the most restrictive orifices in the flow path and the pressure drops across those orifices. The most restrictive orifice is the metering notch 22 of the reciprocal control spool 8. The operator can vary the cross sectional area of the metering notch 22 by moving control spool 8. While this controls one variable which helps determine the flow rate, it provides insufficient control because flow rate is also directly proportional to the square root of the total pressure drop in the system, which occurs primarily across orifice 22. For example, adding material to the bucket of a front end loader might increase the pressure in the bottom chamber 10 of the cylinder housing 14, which would reduce the difference between that pressure and the pressure provided by the pump 4. Without pressure compensation, this reduction of the total pressure drop would reduce the flow rate and thereby reduce the speed of the piston 16 even if the operator would hold the metering notch 22 at a constant cross sectional area.

As noted earlier, U.S. Pat. No. 4,693,272 described an apparatus which enables the operator to control piston speed by manipulating only one variable (the area of the metering notch 22). In that apparatus, a pressure compensating apparatus is employed which maintains the pressure drop across the metering notch 22 (where most of the pressure drop of the systems occurs) approximately constant in the face of continuous variations in the various load pressures seen by each of the valves in the valve assembly. The embodiment described herein employs essentially the same pressure compensation system as described in U.S. Pat. No. 4,693,272, with the improvements described herein. The claimed improvements are not, however, limited for use only in valves described herein or in U.S. Pat. No. 4,693,272.

The pressure compensation apparatus is based upon a pressure compensating check valve 28. It has a piston 54 which sealingly slides reciprocally in a bore, dividing the bore into a top (in the orientation of FIGS. 1 and 2) chamber 56 which is in communication with feeder passage 24 and a bottom chamber 58. The piston 54 is biased upward by a spring 60 located in the bottom chamber 58. The top side 62 and bottom side 64 of piston 54 have equal areas. As the piston 54 moves downward, it opens a path between top chamber 56 and bridge passage 30. That path is the orifice 26 referred to above.

The pressure compensating system senses the pressures at each powered workport of each valve in the assembly, chooses (by means of a shuttle valve system to be described below) the highest of these workport pressures and uses it to control the input of the pump 4, which is a variable displacement pump whose output is designed to be the sum of the pressure at its input 66 plus a constant pressure, known as the margin. As used herein, the terms "input 66" and "input port 66" refer to the feature which is often described as a "displacement control port". As will be described below, the pressure compensating check valve 28 causes this margin pressure to be the approximately constant pressure drop across the metering notch 22.

The shuttle valve system (which in the multi-valve array embodiment described herein is part of the load sense circuit) of each of the valves of the array (42, 68, 70) will now be described in terms of the middle value 42.

Valve 42 (as well as valves 68 and 70) has a sensing shuttle valve 72. The inputs are (a) the bridge passage 30 (via shuttle passage 74) which sees the pressure of the powered one of workport 36 or 44 (or the pressure of reservoir core 50 if the spool 8 is in neutral) and (b) the through-passage 76 of the next downstream valve 70 which has the highest of the powered workport pressures in the valves downstream from middle valve 42. The sensing shuttle valve 72 operates to transmit the higher of pressures (a) and (b) to the sensing shuttle valve 72 of the adjacent upstream valve 68 via the through-passage 76 of the middle valve 42.

The through-passage 76 of the valve 68 opens into the input passage 78 of the isolator 80. Therefore, in the manner just described, the highest of all the powered workport pressures in the valve assembly is transmitted to the input 78 of the isolator 80 which, in a manner to be described below, produces the highest workport pressure at its output 82. (In the device disclosed in U.S. Pat. No. 4,693,272, there is no isolator and the highest workport pressure is applied directly to the input 66 of pump 4.) The pressure transmitted to the isolator input 78 is the first load-dependent pressure, and the pressure transmitted from the isolator output 82 is the second load-dependent pressure.

The pressure at output 82 of the isolator 80 is applied to the input 66 of the pump 4 by means of a transfer passage 84 in each valve which is in communication with the corresponding transfer passage 84 in each adjacent valve. In addition, by means of the cross passage 86 of each valve, the pressure at the output 82 of the isolator 80 is applied (if the yet-to-be-described anti-backflow shuttle valve 88 is open) to the bottom chamber 58 of the pressure compensating check valve, thereby exerting pressure on the bottom 64 of the piston 54. (In the device disclosed in U.S. Pat. No. 4,693,272, there is no anti-backflow shuttle valve 88, and the highest workport pressure is always applied to the bottom side 64 of the pressure compensating check valve piston 54.)

Assuming that anti-backflow shuttle valve 88 is open, the bottom chamber 58 of the pressure compensating check valve sees the highest workport pressure. Because the areas of bottom 64 and top 62 sides of the piston 54 are the same, fluid flow is throttled at orifice 26 so that the pressure in the top chamber 56 of compensation valve 28 is approximately equal to the highest workport pressure. [This is the "second load-dependent pressure". In other embodiments, the second load-dependent pressure may be some other function of the highest workport pressure.] This pressure is communicated to one side of metering notch 22, via feeder passage 24. The other side of metering notch 22 is in communication with the supply passage 20, which has the pump output pressure, which is equal to the highest workport pressure plus the margin. As a result, the pressure drop across the metering notch 22 is equal to the margin. Changes in the highest workport pressure are seen both at the supply side (passage 20) of metering notch 22 and at the bottom 64 of pressure compensating piston 54. In reaction to such changes, the pressure compensating piston 54 finds a balanced position so that the load sense margin is maintained across metering notch 22.

Structure and Operation of the Isolator

As compared to the device disclosed in U.S. Pat. No. 4,693,272, the role of the isolator 80 is to contain fluid in the load sensing shuttle network entirely within the valve assembly, rather than to direct it to the remote external pump input 66 through a hose 90.

Figure 4:
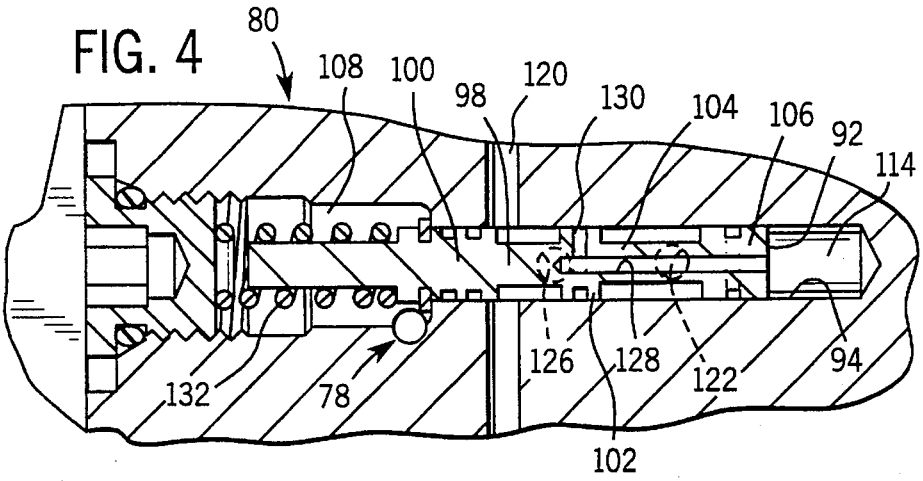
FIG. 4 is a sectional view of an embodiment of the isolator claimed herein, showing it in its normally open state.
Figure 5:
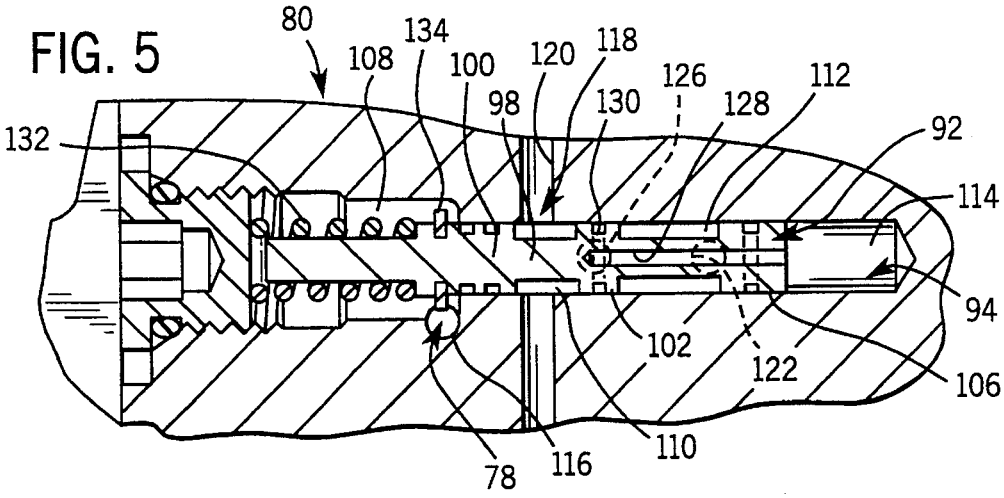
FIG. 5 is a sectional view of the isolator showing it in a metering state.
Figure 6:
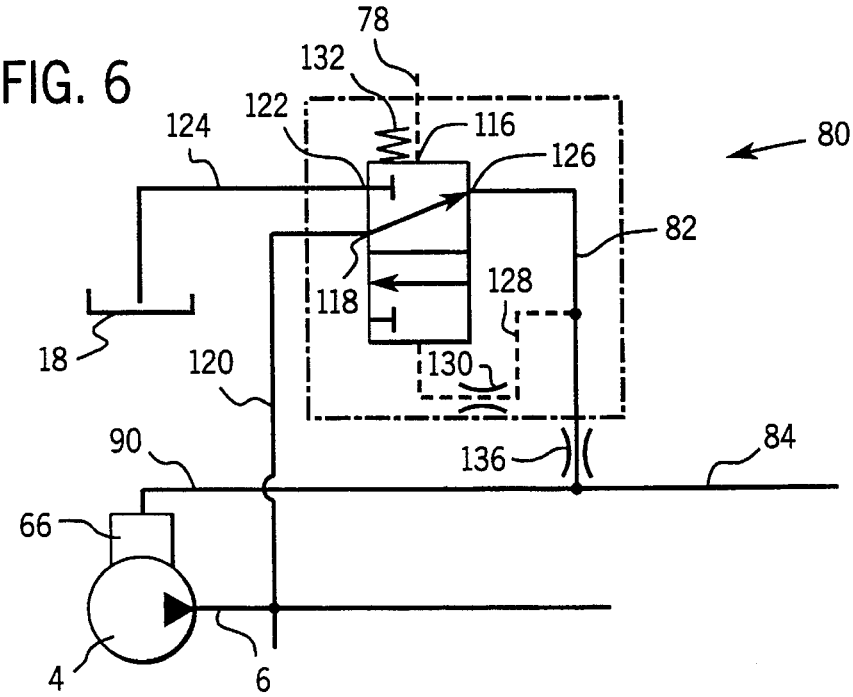
FIG. 6 is a diagram of an embodiment of the isolator.

As shown in FIGS. 4 and 5, the isolator 80 comprises an isolator spool 92 located in a bore 94 in the inlet section 96 of the valve assembly which is affixed to and in communication with the outermost valve 68 of the valve assembly on the inlet side. The isolator spool 92 has a first narrowed section 98 separating a first land 100 from a second land 102, and a second narrowed section 104 separating the second spool land 102 from a third land 106. This structure divides the bore 94 into an inlet chamber 108 on the outboard side of land 100, a connecting chamber 110 between the first and second lands 100 and 102, a reservoir chamber 112 between the second and third lands 102 and 106, and a feedback chamber 114 on the outboard side of the third land 106. The bore 94 has a load sense signal input port 116 for the input passage 78, a pump input port 118 for the pump output passage 120, a reservoir port 122 for the reservoir passage 124 and an output port 126 for the isolator output passage 82. The spool 92 has within it an L-shaped passage ("feedback bore") consisting of a longitudinal portion 128, which extends from the feedback chamber 114 through the third land 106 and second narrowed section 104 and into the second land 102. There it intersects a lateral portion 130 which exits the spool surface at the second land 102 and is always connected to the output passage 82 via the output port 126. An optional spring 132 biases the spool 92 toward the feedback chamber 114, and a spring retainer 134 limits travel in that direction. A restrictive orifice 136 separates the output passage 82 from the transfer passages 84.

When the system is in a neutral state (FIG. 4) such that none of the loads is in motion, the highest workport pressure at the input 78 of the isolator 80 is equal to the pressure in the reservoir 18, which may be assumed to be zero. Pump output pressure is transmitted through the pump output passage 120, through the pump input port 118 and into the connecting chamber 110 of isolator 80 and out of the port 126 into the output passage 82. This pressure is also sensed at the feedback chamber 114 through the spool's internal passages 130 and 128 and therefore tends to push the spool 92 toward the inlet chamber 108 (i.e., to the left in FIGS. 4 and 5). As the spool moves in that direction, the flow path through the connecting chamber 110 to the isolator output port 126 and the output passage 82 begins to be choked off by the land 102 covering the port 126. See FIG. 5. If the pressure in the feedback chamber 114 becomes high enough (as pump output pressure increases) to continue to push the spool 92 to the left, the isolator output port 126, and hence the output passage 82, will be connected to the reservoir chamber 112. Pressure in the output passage 82 and the feedback chamber 114 will be bled off through the reservoir port 122. This will regulate the pressure in the output passage 82 and feedback chamber 114 to an equilibrium value. Since, in the present embodiment, both ends of spool 92 have the same cross sectional area, this equilibrium will be reached when pressure in the feedback chamber 114 (which is communicated to output passage 82) reaches the sum of the pressure in the inlet chamber 108 (the first load-dependent pressure) plus the spring 132 pressure (i.e., the force applied by (optional) spring 132 divided by the cross sectional area of the spool 92). See FIG. 5.

In the present embodiment, the spring value is very light (approximately zero). In that case, the equilibrium will be reached when pressure in the feedback chamber 114 reaches the pressure in the inlet chamber 108 (which is the highest workport pressure). The pressure in feedback chamber 114 is communicated from the output passage 82 via the port 126. From the output passage 82, this pressure (the second load-dependent pressure) is transmitted to the pump load sense input 66. The pump output will then be the highest workport pressure plus margin pressure.

As a result, the pump input 66 sees the highest workport pressure (second load-dependent pressure), but the oil in the load sensing shuttle system does not leave the valve assembly. It is stopped at the isolator input 78, which is located at the inlet section 96 of the valve assembly. The pump 4 provides its own constant source of oil, through the isolator 80 (path 6, 120, 118, 110, 126, 82, 84, 90, 66), to keep the hose 90 to pump 4 filled with oil. When the load sense pressure changes, the new pressure is transmitted to the load sense port 66 without the need to use oil from the valve workports, and load dipping is substantially reduced. Since passage 90 is filled with oil from the pump 4, system response times are improved as well.

In the present embodiment, the first and second load-dependent pressures are approximately equal to each other and to the highest workport pressure. The invention is not, however, so restricted. In other embodiments, variation in system components could make the two load dependent pressures differ from each other and/or differ from the highest workport pressure. This could occur, for example, if the ends of the spool 92 had different areas or the spring 132 had a more than negligible value. The second load-dependent pressure would then be a function of the first load-dependent pressure.

The isolator is not limited to being used in a valve assembly such as described above. Rather, it may be used in many other embodiments, including embodiments which are not pressure compensating valve systems. The isolator may be employed wherever it is useful to transmit a variable pressure to another part of an hydraulic circuit without allowing fluid to flow to that other part.

Structure and Operation of the Anti-Backflow System

As noted above, the need for the system for preventing backflow arises because of a solution to the "bottoming-out" problem. The bottoming-out problem is that, when a piston driving a load reaches the limit of its movement in the cylinder, fluid stops flowing, with the result that there is no pressure drop across the metering notch 22. The bottomed-out workport thereby has the highest workport pressure, and it is equal to the pump pressure. Because the pressure compensation system described above causes the same pressure drop at the metering notch 22 of each of the reciprocal control spools in the valve assembly, none of the loads sees any flow and none can move. The system is hung up.

The solution for the hang-up problem is placing a load sense relief valve 138 on the transfer passage 84, set to relieve at a pressure lower than the pump compensator setting minus margin. In prior art valves which employ such a sense relief valve 138 but which lack the anti-backflow system, the relief valve 138 communicates directly with the bottom side 64 of the piston 54 of each pressure compensating check valve 28 in the assembly. When activated by a pressure exceeding its set point, the sense relief valve 138 opens to the reservoir 18, which limits the pressure seen at the bottom sides 64 of the pistons 54 and thereby allows a pressure drop to be seen at each metering notch 22. In effect, the load sense relief valve 138 takes the bottomed out load out of the pressure compensation system and allows the system to be compensated at the load sense relief valve 138 setting, which restores movement to the loads which are not bottomed out.

As noted above, this solution may, however result in another problem. Undesirable backflow may occur when, due to an external force applied to an actuator's geometry, a work port builds up pressure significantly higher than the load sense relief setting. This could happen, for example, if a backhoe boom is extended over a heavy weight, the weight is attached to the bucket by a chain and then the weight is lifted off the ground by curling the bucket outward. This can build a high pressure in the valve work port 36 connected to the boom cylinder chamber 10. If that work port pressure is greater than the pressure at the pump's output 6, the pressure compensating piston 54 may open orifice 26, resulting in fluid backflow through the metering notches 22 toward the pump 4, causing the load to drop until the work port 36 pressure is reduced to the level of the load sense relief valve 138 setting. In effect, in this condition the check-valve function of the pressure compensating check valve 28 is lost.

To solve this problem, an anti-backflow switching valve is placed in one or more of the valves (68, 42, 70) between the bridge passage 30 and that valve's passage 84. In this embodiment, the anti-backflow switching valve is a shuttle valve 88, but the invention is not so restricted. The output of the anti-backflow shuttle valve 88 is routed to the bottom side 64 of the pressure compensating piston 54. The anti-backflow shuttle valve 88 thus compares the pressure in the passage 84 (which is either the highest work port pressure or the set point pressure of the load sense relief valve 138) with pressure in the bridge passage 30 (which is the powered workport pressure for the particular valve). The shuttle valve 88 sends the higher of the passage 84 pressure or the passage 30 pressure to the bottom side 64 of the pressure compensating piston 54. If the load sense relief valve 138 has not opened, the passage 84 pressure will be the highest work port pressure, and the pressure compensation system will operate as described above. If the load sense relief valve 138 has opened, the passage 30 pressure may be higher than the passage 84 pressure. If it is, the anti-backflow shuttle valve 88 transmits that pressure to the bottom side 64 of the pressure compensating piston 54. Because this latter situation will occur only when the pressure of workport 36 is greater than the pump output pressure (which is seen at the top side 62 of the pressure compensating piston 54), the piston 54 will move up and close the orifice 26, thereby preventing the back flow described above.

Although the preferred embodiments of the invention have been described above, the invention claimed is not so restricted. There may be various other modifications and changes to these embodiments which are within the scope of the invention. Thus, the invention is not to be limited by the specific description above, but should be judged by the claims which follow.

We claim:

1. A load-sensing, pressure-compensating hydraulic valve assembly for enabling an operator to control the flow of pressurized fluid in a fluid path from a variable displacement hydraulic pump to an hydraulic actuator subject to a load force which creates a load pressure, the pump having a load sensing input and producing an output pressure which is a constant amount greater than a pump input pressure at the load sensing input, the hydraulic valve assembly comprising:

(a) a first valve element and a second valve element juxtaposed to provide between them a metering orifice in the fluid path, at least one of the valve elements being movable under the control of the operator to vary the size of the metering office and thereby to control the flow of fluid to the hydraulic actuator;

(b) means forming a sensing passageway that senses the load pressure at the hydraulic actuator;

(c) isolator means, in communication with the sensing passageway, said isolator means having a first chamber and a spool that communicates a load-dependent pressure from the first chamber to a second chamber, said second chamber being in communication with an output port through an axial passageway in said spool and an orifice extending radially from said axial passageway for further communication with the said output port and said load sensing input on the pump, said spool blocking the flow of fluid between the first chamber and the pump load sensing input and said spool being movable between a first position in which pump output pressure is communicated to the output port and a second position in which a second load-dependent pressure is communicated from said second chamber to the output port; and (d) pressure compensating means, in communication for receiving the load-dependent pressure transmitted by the isolator means, for maintaining across the metering orifice a pressure drop equal to the constant amount.

2. A hydraulic valve assembly for feeding hydraulic fluid to a load from a pump, the pump having a load sensing input and producing an output pressure which at any time is the sum of input pressure at a pump input port and a constant margin pressure, the hydraulic system comprising:

(a) a pressure compensating valve apparatus adapted to feed fluid from the pump to the load through a metering orifice and to provide a constant pressure drop across the metering orifice, the valve apparatus having a load sense circuit which communicates a first load-dependent pressure to an isolator and a second load-dependent pressure from the isolator to the metering orifice, the pressure drop across the metering orifice being the difference between the pump output pressure and the second load-dependent pressure;

(b) the isolator comprising a reciprocally sliding spool in a bore defined by one or more bore surfaces, the spool having a plurality of lands and narrow portions which, with the one or more bore surfaces, define:

an input chamber in communication with the load sense circuit so that the first load-dependent pressure produces an input force urging the spool in a first direction;

a connecting chamber in communication with the pump output pressure and adapted to connect the pump output pressure to an isolator output port in a bore inner surface as the spool moves in the first direction and to disestablish that connection as the spool moves in a second direction opposite the first direction;

a reservoir chamber in communication with the reservoir and adapted to establish communication between the isolator output port and the reservoir as the spool moves in the second direction and to disestablish that connection as the spool moves in the first direction;

a feedback chamber in communication with the isolator output port through a feedback bore in the spool, the pressure in the feedback chamber producing a feedback force urging the spool in the second direction;

wherein pump output pressure is communicated to the feedback chamber and urges the spool in the second direction and wherein continued movement in the second direction disestablishes the connection between the pump output pressure and the isolator output port and establishes a connection between the reservoir and the isolator output port and therefore the feedback chamber;

whereby the spool tends at any time to an equilibrium position at which the second load-dependent pressure at the isolator output port is a function of the first load-dependent pressure;

wherein the isolator output port is in communication with the pump input port and with the load sense circuit which communicates the second load-dependent pressure to the metering orifice of the pressure compensating valve apparatus; and (c) whereby the pump input port sees the second load-dependent pressure but does not receive fluid flow from the load sense circuit and whereby the constant pressure drop across the metering orifice of the pressure compensating valve assembly is the margin pressure.

3. A hydraulic valve assembly as recited in claim 2, in which the first and second load-dependent pressures are approximately equal to each other.

4. In a hydraulic system for feeding hydraulic fluid from a pump through an array of pressure compensating hydraulic valve sections having one or more workports to a plurality of hydraulic actuators in communication with pressure in the workports, the pump being of the type which produces an output pressure which is a constant amount greater than the pump input pressure, the array being of the type in which the highest pressure of all the workports is sensed and transmitted to a pressure relief valve and to a pressure compensating valve in each valve section a load sense pressure equal to the lower of (a) the set point pressure of the pressure relief valve and (b) the highest workport pressure, and in which each pressure compensating valve provides the load sense pressure at one side of a metering orifice which sees on the other side the pump output pressure so that the pressure drop across the metering orifice is equal to the constant amount, the improvement comprising:

in at least one valve section, a switching valve between the relief valve and the pressure compensating valve, the switching valve transmitting to the pressure compensating valve of said at least one valve section the higher of (a) the load sense pressure or (b) the highest workport pressure of said at least one valve section, whereby the pressure compensating valve will be held closed to prevent backflow whenever the pressure relief valve is open.

5. A hydraulic system as recited in claim 4, wherein the switching valve is a shuttle valve.

* * * * *